United States Patent [19]

Breitschmid

[11] Patent Number: 4,809,389

[45] Date of Patent: Mar. 7, 1989

[54] INTERDENTAL CLEANING DEVICE

[75] Inventor: Ulrich Breitschmid, Meggen, Switzerland

[73] Assignee: Curaden AG, Kriens, Switzerland

[21] Appl. No.: 141,082

[22] Filed: Jan. 5, 1988

[51] Int. Cl.[4] ..... A46B 9/04

[52] U.S. Cl. ..... 151/167.1; 15/144 R; 15/145; 15/176; 15/172; 15/206

[58] Field of Search ..... 15/167.1, 172, 144 R, 15/206, 184, 176, 145, 164

[56] References Cited

U.S. PATENT DOCUMENTS

| | | | |
|---|---|---|---|
| 1,651,251 | 11/1927 | Calkins | 15/172 |
| 1,691,814 | 11/1928 | King | 15/184 |
| 2,083,728 | 6/1937 | Mayer | 15/176 |
| 2,582,404 | 1/1952 | Zavada | 15/167.1 |
| 2,719,998 | 10/1955 | Hibbs | 15/176 |
| 3,559,226 | 2/1971 | Burns | 15/167.1 |
| 4,222,143 | 9/1980 | Tarrson et al. | 15/167.1 |
| 4,691,404 | 9/1987 | Tarrson et al. | 15/144 R |

FOREIGN PATENT DOCUMENTS

| | | | |
|---|---|---|---|
| 493664 | 6/1950 | Belgium | 15/184 |
| 316733 | 4/1934 | Italy | 15/164 |
| 601 | 5/1950 | Switzerland | 15/164 |

*Primary Examiner*—Harvey C. Hornsby
*Assistant Examiner*—Christine A. Peterson
*Attorney, Agent, or Firm*—Brady, O'Boyle & Gates

[57] ABSTRACT

An interdental cleaning device having a clevis freely pivoted on one end of a shank. A brush carrier is detachably connected to and extends through the clevis and is engageable with a plurality of recesses formed on the end of the shank so that the clevis and associated brush carrier can be adjustably fixed at various angles to facilitate cleaning the interdental spaces from different sides of the oral cavity. A housing is provided which can be slidably mounted on the shank to provide either a handle for the device or a protective covering for the brush, carrier and clevis when not in use.

13 Claims, 2 Drawing Sheets

INTERDENTAL CLEANING DEVICE

BACKGROUND OF THE INVENTION

In dental hygiene, it is not only important to clean the outer surfaces of teeth to prevent the formation of cavities but also to clean the interdental spaces, and to massage the gums to prevent periodontosis which is a disease involving the supporting structure of the teeth, such as the gums and periodontal membranes; and periodontitis which is the inflammation of the connective tissue membrane covering the cement layer of a tooth.

While tooth brushes are employed for the general cleaning of teeth, dental floss has been customarily used to clean the spaces between the teeth.

After considerable research and experimentation, the interdental cleaning device of the present invention has been devised to not only clean the interdental spaces but to massage the gums to reduce the occurrence of periodontosis and periodontitis.

The interdental cleaning device of the present invention comprises, essentially, a thin brush having a carrier removably mounted in the head of a clevis freely pivoted on the end of a shank. The brush carrier extends through the clevis head and is engageable with a respective recess provided in the end of the shank, whereby the brush can be fixedly adjusted to various angles relative to the longitudinal axis of the shank, to thereby facilitate cleaning the interdental spaces from different sides of the oral cavity. A housing is provided which can be selectively mounted on one end of the shank to provide a handle when using the brush, or on the opposite end of the shank to cover the brush when not in use.

DESCRIPTION OF THE PREFERRED EMBODIMENT

Figure 1:
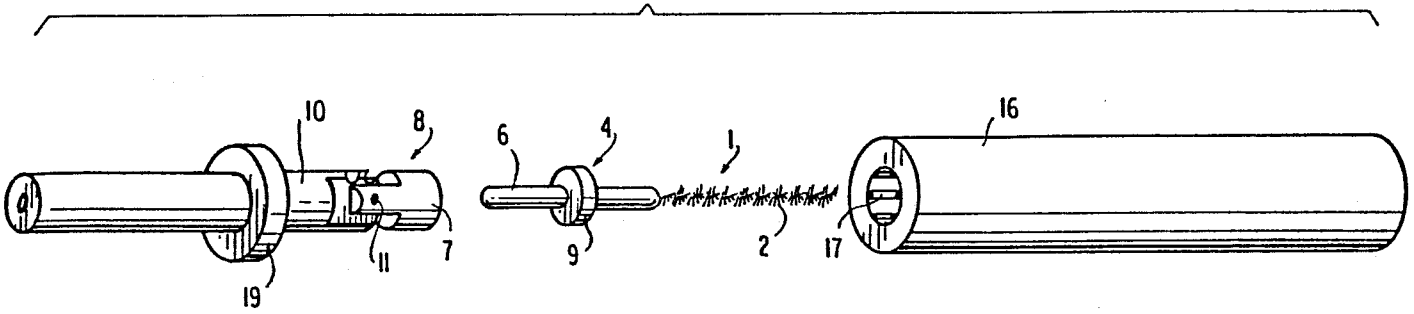
FIG. 1 is an exploded view showing the components of the interdental cleaning device of the present invention.
Figure 2:
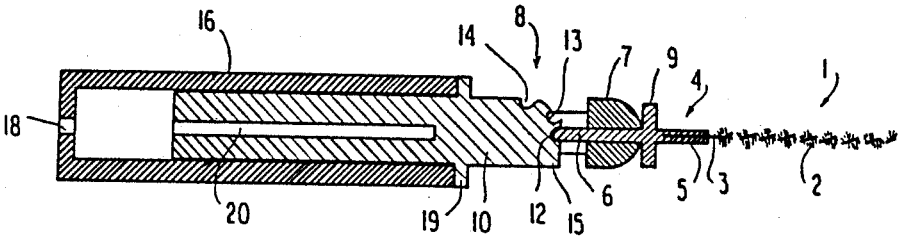
FIG. 2 is a sectional, side elevational view of the device in the assembled position.

Referring to the drawings and more particularly to FIGS. 1 and 2, the interdental cleaning device of the present invention comprises, a thin brush 1 of the type having a plurality of bristles 2 mounted on a twisted wire 3 having one end embedded within a carrier 4 as at 5. The carrier 4 includes a stem portion 6 adapted to be slidably mounted within the head 7 of a clevis 8, the carrier also being provided with a disc flange 9 forming a stop to limit the insertion of the carrier stem portion through the clevis head 7, and to facilitate manually removing the brush carrier 4 from the clevis head 7, to be more fully described hereinafter.

Figure 3:
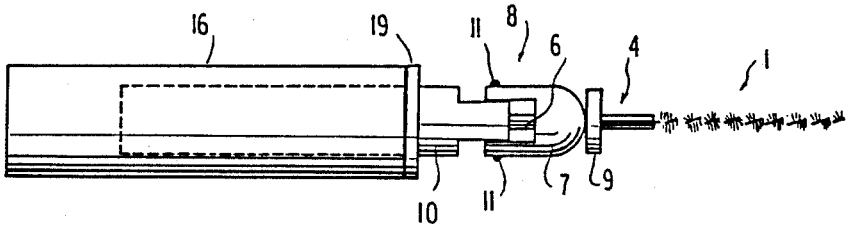
FIG. 3 is a top elevational view of the device shown in FIG. 2.

As will be seen in FIG. 3, the clevis 8 is freely pivoted to one end of a shank 10 by pins 11, and as will be seen in FIG. 2, the end of the shank is provided with a plurality of recesses 12, 13 and 14 adapted to selectively receive the end of the carrier stem portion 6. The recess 12 is aligned with the longitudinal axis of the shank 10 so that when the end of the carrier stem is received therein, the brush 1 will be positioned as shown in FIG. 2. The recesses 13 and 14 are positioned on the end of the shank so that the clevis 8 and associated brush carrier 4 can be adjusted and fixed at positions at 45° and 90°, respectively, relative to the longitudinal axis of the shank 10, to reduce the length of the device, to thereby facilitate cleaning the interdental spaces from different sides of the oral cavity.

When the brush is oriented in the position shown in FIG. 2, the disc flange 9 abuts the clevis head 7 and the end of the carrier stem is received within the recess 12. To remove the brush 1 and associated carrier 4 from the clevis 8, the clevis is pivoted in a clockwise direction, thereby forcing the end of the stem 6 out of the recess 12 to slide the carrier slightly outwardly relative to the clevis head 7. When the end of the stem 6 engages the corner 15 of the shank 10, the stem 6 is moved further outwardly from the clevis head 7 so that the user can grasp and pull the disc flange 9 to complete the removal of the brush 1 from the clevis 8.

To complete the structural details of the interdental cleaning device, a tubular housing 16 is provided which can be slidably mounted on the shank 10, as shown in FIG. 2, to provide a handle for the device, or it can be slidably mounted on the shank 10 from the opposite direction to provide a cover for the brush 1, carrier 4 and clevis 8 when not in use. As will be seen in FIG. 1, the interior wall of the tubular housing 16 is provided with lands 17 to facilitate the frictional engagement of the housing 16 with the shank 10, and as will be seen in FIG. 2, a vent hole 18 is provided in the end wall of the housing 16 to allow any air trapped within the housing, while mounting the housing on the shank, to escape. The shank 10 is provided with a flange 19 engageable with the open end of the housing 16 to limit the travel of the housing when mounted on the shank from either direction, and a longitudinally extending bore 20 is formed in the shank 10 for receiving an arbor when fabricating the device.

Figure 4:
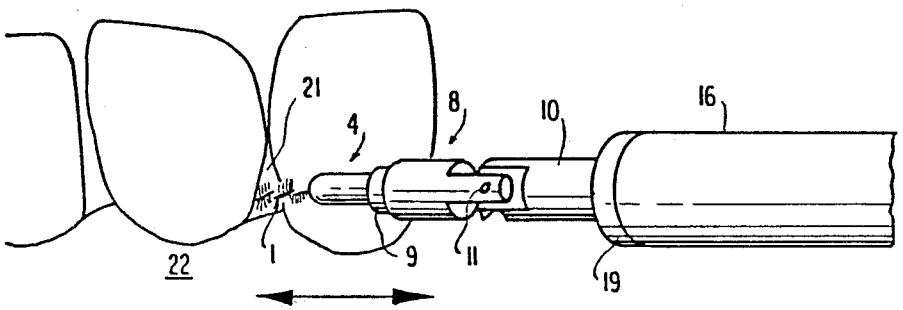
FIG. 4 is a fragmentary, perspective view showing the device in the operative position cleaning interdental spaces.

In use, as will be seen in FIG. 4, the clevis 8 and associated carrier 4 is set at the desired position, as described hereinabove, and the user positions the brush 1 in the interdental space 21 and moves the brush back and forth in the direction of the arrows. The bristles of the brush not only clean the interdental space but also engage the gum 22 to thereby effectively massage the gum.

From the above description, it will be readliy apparent that the construction and arrangement of the interdental cleaning device of the present invention provides a device wherein the brush can be positioned in a selected position to reduce the length of the device to thereby facilitate the cleaning of interdental spaces from different sides of the oral cavity. Brushes can be easily changed and the housing performs the dual function of a handle while the brush is being used and as a cover for protecting the brush when not in use. The main components of the cleaning device are made of plastic and dimensioned so that the device can be easily carried in a pocket of a person.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. An interdental cleaning device comprising, a shank, clevis means freely pivoted to one end of said shank, said clevis means including a head, carrier means including a stem portion detachably slidably mounted within and extending through said clevis head, brush means mounted on said carrier means and protruding from one side of said head, a plurality of recesses provided on said one end of the shank, said recesses being disposed at various angles relative to the longitudinal axis of the shank, said stem portion having a free end protruding from the opposite side of said head and being receivable in a selected recess by sliding said stem portion through said head in one direction, whereby the clevis, carrier means and brush means may be adjusted and fixed at various angular positions relative to the longitudinal axis of the shank, to thereby facilitate cleaning the interdental spaces from different sides of the oral cavity, and sliding said stem portion in the opposite direction releases the fixed angular position of said clevis, carrier means and brush means and detachment of said carrier means from said clevis means.

2. An interdental cleaning device according to claim 1, wherein the clevis means is freely pivoted to one end of the shank by pins extending transversely to the longitudinal axis of the shank.

3. An interdental cleaning device according to claim 1, wherein the brush means comprises a plurality of bristles secured to a twisted wire, one end of said wire being embedded within the carrier means.

4. An interdental cleaning device according to claim 1, wherein the carrier means is provided with a disc flange forming a stop to limit the insertion of the stem portion through the clevis head and said free end of said stem portion into a selected recess.

5. An interdental cleaning device according to claim 1, wherein the recesses are respectively disposed in alignment with the longitudinal axis of the shank, at 45° and at 90° relative to the longitudinal axis of the shank.

6. An interdental cleaning device according to claim 1, wherein a housing is slidably mounted on one end of the shank to provide a handle for the device.

7. An interdental cleaning device according to claim 6, wherein the housing is slidably mounted on the opposite end of the shank to provide a cover for the brush means, carrier means and clevis means.

8. An interdental cleaning device according to claim 6, wherein a flange is provided on said shank to limit the travel of the housing when slidably mounted thereon.

9. An interdental cleaning device comprising, a shank, clevis means freely pivoted to one end of said shank and including a head, carrier means including a stem portion slidably mounted within and extending through the clevis head, brush means mounted on said carrier means, said shank having a recess on said one end, the end of the stem portion being receivable in said recess, to thereby fix the clevis and associated carrier relative to the shank, the end of the shank being provided with a corner engageable with the end of the stem portion when the clevis means is pivoted in a direction away from said recess, to thereby slide the carrier means outwardly from the clevis head to facilitate removing the brush means from the clevis means.

10. An interdental cleaning device comprising, a shank, pivot means at one end of said shank, carrier means detachably connected to said pivot means, brush means mounted on said carrier means, said carrier means having a stem portion moveable in one direction into and through said pivot means into engagement with said one end of said shank to connect said brush means to said shank and to fix said pivot means, carrier means and brush means in a selected angular position relative to said shank, and moveable in the opposite direction to release the selected fixed angular position of said pivot means, carrier means and brush means and to detach said carrier means and brush means from said pivot means, to thereby facilitate cleaning the interdental spaces from different sides of the oral cavity.

11. An interdental cleaning device comprising, a shank, clevis means freely pivoted to one end of said shank, said clevis means including a head, carrier means including a stem portion detachably slidably mounted within and extending through said clevis head, brush means mounted on said carrier means, a plurality of recesses provided on said one end of the shank, said recesses being disposed at various angles relative to the longitudinal axis of the shank, the end of the stem portion being receivable in a selected recess, whereby the clevis, carrier means and brush means may be adjusted and fixed at various angular positions relative to the longitudinal axis of the shank to facilitate cleaning the interdental spaces from different sides of the oral cavity, and the end of the shank provided with a corner engageable with the end of the stem portion when the clevis means is pivoted in a direction away from said recesses, to thereby slide the carrier means outwardly from the clevis head to facilitate removing the brush means from the clevis means.

12. An interdental cleaning device according to claim 10, including recesses in said one end of said shank disposed in alignment with the longitudinal axis of the shank and at an angle relative to the longitudinal axis of the shank for receiving said stem portion.

13. An interdental cleaning device comprising, a shank, clevis means freely pivoted to one end of said shank and including a head, carrier means including a stem portion slidably mounted within and extending through the clevis head, brush means mounted on said carrier means, the end of the stem portion extending into locking engagement with said one end of said shank to thereby fix the clevis and associated carrier relative to the shank, the end of the shank being provided with a corner engageable with the end of the stem portion when the clevis means is pivoted in at least one direction, to thereby slide the carrier means outwardly from the clevis head to facilitate removing the brush means from the clevis means.

* * * * *